US006321929B1

(12) United States Patent
Weshler et al.

(10) Patent No.: US 6,321,929 B1
(45) Date of Patent: Nov. 27, 2001

(54) BASKET WITH INTEGRALLY-FORMED RECEPTACLE AND METHOD OF USING SAME

(75) Inventors: Benjamin S. Weshler, Old Westbury, NY (US); Deborah Ann Cross, Atlanta, GA (US)

(73) Assignee: The Coco-Cola Company, Atlanta, GA (US)

( * ) Notice: Subject to any disclaimer, the term of this patent is extended or adjusted under 35 U.S.C. 154(b) by 0 days.

(21) Appl. No.: 09/348,223

(22) Filed: Jul. 6, 1999

Related U.S. Application Data

(60) Provisional application No. 60/091,739, filed on Jul. 6, 1998.

(51) Int. Cl.[7] ..... B65D 1/36

(52) U.S. Cl. ..... 220/555; 206/217; 220/23.8; 220/501

(58) Field of Search ..... 220/23.8, 23.86, 220/23.2, 23.83, 555, 500, 501, 486, 737; 206/217, 541, 549, 564; 280/DIG. 3, DIG. 4, 47.26; 211/41.1, 41.2, 41.3

(56) References Cited

U.S. PATENT DOCUMENTS

| | | | | |
|---|---|---|---|---|
| D. 159,666 | | 8/1950 | Ringler . | |
| D. 160,634 | | 10/1950 | Lamprecht . | |
| D. 256,434 | | 8/1980 | O'Donnal . | |
| D. 283,457 | | 4/1986 | Smith . | |
| 1,176,052 | * | 3/1916 | Hagarty | 217/162 X |
| 2,241,707 | * | 5/1941 | Langel | 220/23.6 |
| 2,645,392 | * | 1/1953 | Gottsegen et al. | 206/541 |
| 3,339,796 | | 9/1967 | Struble . | |
| 3,611,450 | | 10/1971 | Bost . | |
| 3,670,938 | * | 6/1972 | Brocato | 206/562 |
| 4,033,461 | * | 7/1977 | Nevai | 211/85.25 |
| 4,219,035 | * | 8/1980 | Deconinck | 211/65 |
| 4,541,539 | * | 9/1985 | Matthews | 220/555 |
| 4,941,586 | | 7/1990 | Tarna . | |
| 4,981,232 | | 1/1991 | Wynn . | |
| 4,989,742 | | 2/1991 | Powell . | |
| 5,346,309 | * | 9/1994 | Book | 383/4 |
| 5,441,163 | * | 8/1995 | Carrasco | 220/23.86 |
| 5,524,761 | * | 6/1996 | Wayman | 206/545 |
| 5,810,196 | | 9/1998 | Lundy . | |

FOREIGN PATENT DOCUMENTS

| | | | | |
|---|---|---|---|---|
| 2549354 | * | 1/1985 | (FR) | 206/541 |

* cited by examiner

*Primary Examiner*—Allan N. Shoap
*Assistant Examiner*—Joe Merek
(74) *Attorney, Agent, or Firm*—Sutherland Asbill & Brennan LLP

(57) ABSTRACT

A shopping basket has four walls, a bottom and handles for allowing the basket to be carried, and one wall of the basket is provided with a section that projects either outwardly from or inwardly into the shopping basket and is adapted to serve as a receptacle for a bottle or can. This projecting section is integrally formed with the shopping basket wall, is cylindrically shaped with a radius slightly larger than that of a typical can or bottle and has a flat bottom retaining wall so that it is suited to hold securely an open, fluid-filled can or bottle without spilling its contents. Thus, a shopper using the shopping basket will easily be able to drink from a can or bottle and then place it within the receptacle formed from the shopping basket wall, removing it and replacing it as desired, so that the shopper can conveniently and selectively shop and drink from the can or bottle as desired. The walls of the basket and of the section are slightly sloped outward in order to enable more than one basket to be stacked one within another.

14 Claims, 2 Drawing Sheets

BASKET WITH INTEGRALLY-FORMED RECEPTACLE AND METHOD OF USING SAME

This application claims benefit of Ser. No. 60/091,739, filed Jul.6, 1998.

TECHNICAL FIELD

This invention relates to receptacles that are used during retail shopping and, more particularly, to shopping receptacles that allow a shopper to conveniently carry an open fluid bottle simultaneously with the shopping basket.

BACKGROUND OF THE INVENTION

Individuals who shop in retail stores, such as in supermarkets, generally use some sort of receptacle in which to place and carry the items that they wish to purchase until such time as purchase is actually made. The shopper carries these items within the receptacle until he or she has collected all items desired for purchase at that time, at which point the shopper brings the items within the receptacle to a checkout counter for payment. The most commonly-used receptacles are the shopping basket, which is used to hold smaller or fewer items prior to purchase, and the shopping cart or wagon, which is used to hold larger or more items prior to purchase.

Because shopping is an activity that often takes quite some time, especially in this age of large retail stores and supermarkets, a shopper will often get thirsty during shopping or will otherwise have a need for refreshment. It has, therefore, become a common practice for a shopper to select a cold drink, generally in a can or bottle, from one of the shopping displays at the outset of the shopper's route, drink that refreshment during the shopping activity and then pay for that drink at the checkout counter along with the rest of the shopping items.

However, drinking from an open container while shopping can be inconvenient and often difficult to manage, particularly for a shopper using a shopping basket to hold the chosen items prior to purchase. Because a shopper generally requires only one hand to carry a shopping basket, the shopper will have at most one free hand for taking items from the store shelf and placing them into the shopping basket and also for holding and drinking from the drink container.

A shopper who attempts to use the same hand for holding the drink and taking items off the shelves faces the risk of many undesirable results. One such undesirable result is the spilling of the drink, either on the shopper, on one or more of the chosen shopping items, or elsewhere within the store. Another undesirable result is the dropping of either the drink or one or more of the chosen shopping items, thereby possibly breaking packages or other containers and potentially causing injury.

Therefore, a shopper who is carrying an open, fluid-filled bottle or can in one hand and a shopping basket in the other hand would be required to set the drink aside when taking items off the shelves. Unfortunately, this may result in the drink being misplaced by the shopper or forgotten on the floor or shelves. This raises the possibility of the drink container later being broken or its contents spilled, thereby potentially causing injury. Thus, it is inconvenient for the shopper to carry and drink from an open, fluid-filled bottle or can while carrying a shopping basket.

It is, therefore, an object of the current invention to provide a shopper using a shopping basket with a convenient way to enjoy a drink while shopping.

It is another object of this invention to provide a shopper carrying a shopping basket with a convenient receptacle in which to place temporarily the drink when using his or her hands for shopping, without having to set aside or place either the drink or the shopping basket on the floor. It is yet another object of this invention to provide a shopping basket that is able to hold securely an open, fluid-filled bottle or can without spillage. This enables a shopper using the basket to drink from the bottle while shopping without having to set down either the basket or the drink in order to lift items from the shelves.

SUMMARY OF THE INVENTION

These and other objects of the current invention are accomplished by providing, in accordance with the preferred embodiment of the invention, a shopping basket that has four walls, a bottom and handles for allowing the basket to be carried. A section of at least one wall of the basket projects either towards the outside or the inside of the shopping basket and is adapted to serve as a receptacle for a bottle or can. This projecting section is integrally formed with the shopping basket wall, is cylindrically shaped with a radius slightly larger than that of a typical can or bottle, and has a flat bottom retaining wall. This projecting section is suited to hold securely an open, fluid-filed can or bottle without spilling its contents.

Thus, a shopper using the shopping basket will be able to drink from a can or bottle and then place it within the receptacle formed from the shopping basket wall. The shopper can easily remove the can or bottle from the receptacle and replace it as desired so that the shopper can conveniently and selectively shop and drink from the can or bottle as desired. The walls of the section are slightly sloped outward in order to enable more than one basket to be stacked one within another.

BRIEF DESCRIPTION OF THE DRAWINGS

The above and other objects of the invention will be apparent upon consideration of the following detailed description, taken in conjunction with the accompanying drawings, in which the reference characters refer to like parts throughout and in which.

DETAILED DESCRIPTION OF THE INVENTION

Figure 1:
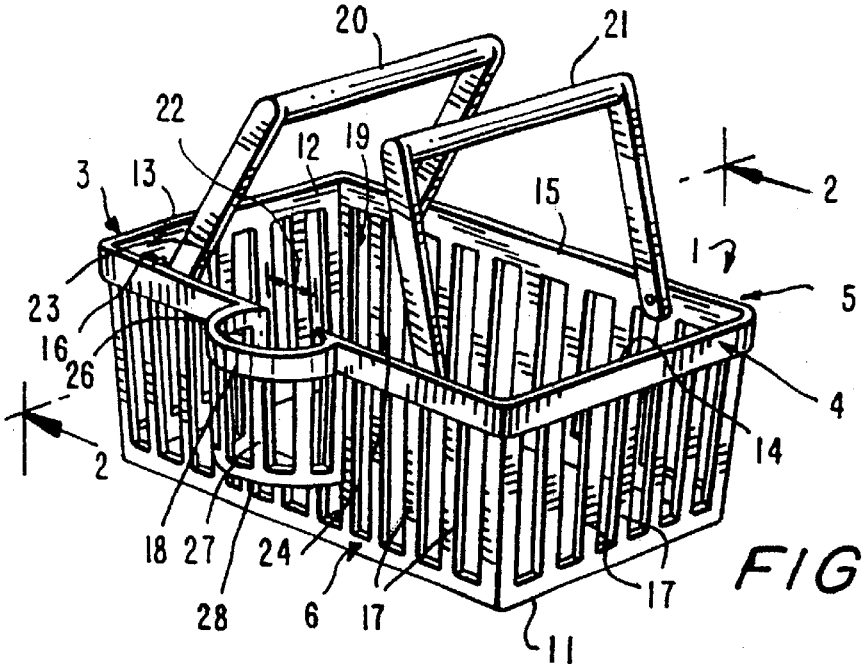
FIG. 1 is a perspective view of the first embodiment of a shopping basket with a receptacle of the current invention.

Referring now to the drawings, FIG. 1 shows a shopping basket of the current invention, designated generally with reference numeral 1. As with prior art shopping baskets of the kind most commonly used in retail stores and supermarkets, basket 1 is preferably a four-sided, rectangularly-shaped basket with a flat bottom. Basket 1 has four walls 3–6, which include opposite end walls 3, 4 and opposite side walls 5, 6 between end walls 3, 4. Of course, basket 1 may have alternate arrangements, such as having more or fewer walls or having only partial walls, in some instances. Basket 1 may be made from any of the materials of which shopping baskets are commonly made, such as a hard, injection-molded plastic, provided that the material provides the basket 1 with the required strength and durability criteria.

Walls 3–6 have upper edges 13–16 that form the boundaries of the opening of the basket 1 and have lower edges that form the boundaries of bottom 11 of basket 1. Walls 3–6 can be formed without openings therethrough in order to prevent items that the shopper has chosen for purchase from falling through the sides or walls 3–6 of basket 1. However, walls 3–6 need not be formed without openings and can be formed of a ribbed or a lattice structure, as long as the gaps or openings in walls 3–6 are sufficiently small or narrow so as to prevent items from falling therethrough. Each of walls 3–6 can be formed by any of the standard constructions in the prior art for shopping baskets that would prevent items from falling through the sides of basket 1 while still providing sufficient strength and structure for basket 1 and saving on material costs. For example, in a first embodiment, as shown in FIG. 1, walls 4, 6 are shown as being formed of vertical ribs 17. Ribs 17 have sufficient strength to prevent deformation of basket 1 during use or during stacking and have sufficiently narrow gaps between them to prevent items from falling through the sides of basket 1 during use of basket 1.

Walls 3–6 of basket 1 are preferably gently sloped outward from their bottom edges to their top edges 13–16 such that the dimensions of opening 12 of basket 1 are larger than the dimensions of bottom 11 of basket 1. The outward slope of walls 3–6 and the fact that opening 12 is larger than bottom 11 allows bottom 11 of one basket 1 to fit within the opening 12 of another basket 1 so that baskets 1 may be neatly stacked one within another for storage.

As with standard prior art shopping baskets, shopping basket 1 may also have one or more handles 20, 21 that are rotatably mounted to the top edges 15, 16 of walls 5, 6 of basket 1, with one handle being fixed on either end of basket 1. Handles 20, 21 are arranged in this fashion so that they can be rotated upwards and be held together in order to fully support basket 1 and its contents. Handles 20, 21 can also be rotated downward and laid flat against top edges 15, 16 of basket 1 in order to allow one or more baskets 1 to be stacked for storage.

Figure 2:
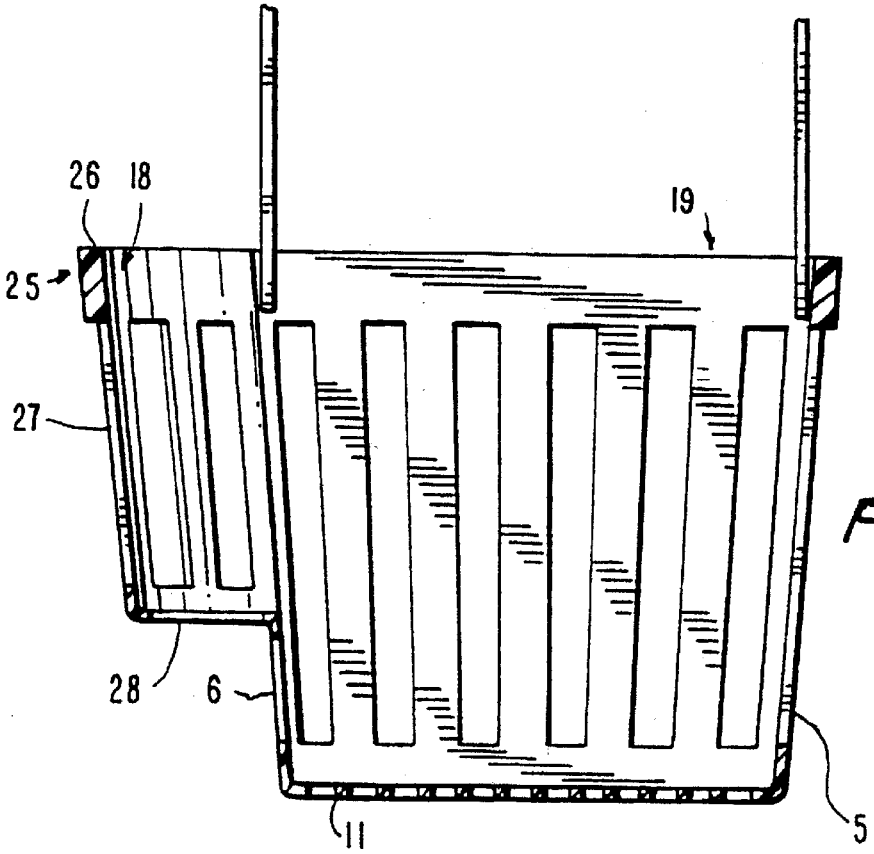
FIG. 2 is a cross-sectional view of the first embodiment of the shopping basket with the receptacle shown in FIG. 1.

In order to accomplish the objects of this invention, basket 1 is also provided with a receptacle 25, as shown in its first embodiment in FIGS. 1 and 2. Receptacle 25 is shown in FIG. 1 as being an integral extension of wall 6 that protrudes outward with respect to basket 1. In the preferred embodiment, receptacle 25 is integrally formed with shopping basket wall 6. Receptacle 25 is shaped to be able to receive a drink container such as a cup, can, or bottle (referred to hereinafter simply as a drink), and retain said drink therein without spilling. Receptacle 25, therefore, may have any cross-sectional shape, but is preferably cylindrically shaped, and should have a radius slightly larger than that of a typical cup, can, or bottle such that it can retain such a container. Receptacle 25 also has a flat bottom retaining wall 28 for supporting a drink or other item placed within receptacle 25.

Figure 5:
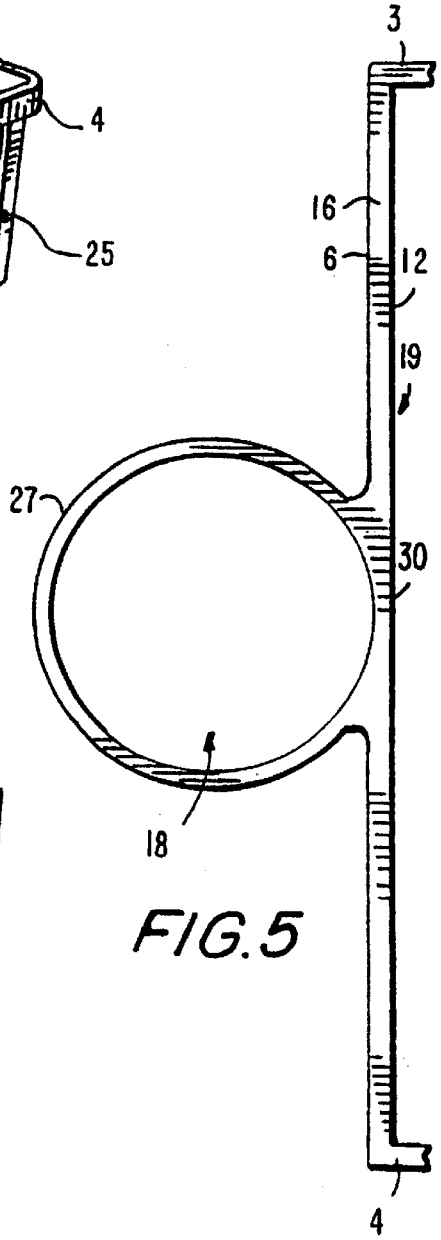
FIG. 5 is a partial top plan view of an alternate form of attachment of the receptacle to the shopping basket in the first embodiment.

In order for receptacle 25 to retain properly a drink therein while preventing the drink from spilling into the inside 19 of basket 1, there must be a sufficient barrier between the inside 18 of receptacle 25 and the inside 19 of basket 1 so that the drink retained within receptacle 25 does not fall into the interior 19 of basket 1. In general, in one embodiment, shown in FIG. 5, the inside 18 of receptacle 25 may be completely distinct from the inside 19 of basket 1, such that wall 6 of basket 1 extends completely and uninterrupted from one end at wall 3 to the other end at wall 4. As such, wall 27 of receptacle 25 abuts wall 6 and may be integrally formed therewith at region 30 but does not interfere with the continuous definition of the opening 12 of basket 1 as defined by wall 6.

In an alternative embodiment of the abutment of basket walls 6 and receptacle wall 27, as shown in FIG. 1, receptacle 25 is not merely an extension of or a protrusion from wall 6 of basket 1, but instead an extension of wall 6 serves as a partial barrier between the inside 18 of receptacle 25 and the inside 19 of basket 1. Top edge 16 of wall 6 extends across the top of wall 6 and terminates at edges 23, 24, leaving opening 22 in wall 6, across which neither wall 6 nor top edge 16 extend. At edges 23, 24, top edge 16 of wall 6 curves outward of basket 1 in a circular shape to form the top edge 26 of wall 27 of receptacle 25. Each of edges 23, 24 forms a return by extending first in the direction of top edge 16 of wall 6 and reversing direction to form the top edge 26 of wall 27 of receptacle 25.

In this fashion, receptacle 25 is formed as a portion of wall 6 of basket 1, as wall 6 of basket 1 extends downward from top edge 16, and wall 27 of receptacle 25 extends downward from top edge 26, and a return is formed at the meeting of walls 6 and 27, i.e., at edges 23, 24. As shown in FIG. 1, the width of opening 22 between edges 23, 24 should preferably be smaller than the diameter of receptacle 25 and also than the diameter of any drink that is retained within receptacle 25. Thus, any drink that is retained within receptacle 25 will not be able to fit through opening 22 between edges 23, 24 and will not thereby be spilled into the interior 19 of basket 1. Accordingly, the drink will be retained safely within receptacle 25.

As with walls 3–6 of shopping basket 1 and with the walls of shopping baskets in general, wall 27 of receptacle 25 is gently sloped outward from its bottom surface 28 to its top edge 26 such that the dimensions, in particular the diameter, of the opening made by top edge 26 is larger than the diameter of its bottom surface 28. The outward slope of wall 27 and the larger diameter of receptacle 25 at its opening than at its bottom allows bottom 28 of one receptacle 25 to be placed within the receptacle 25 of another basket 1 when baskets 1 are stacked for storage. In this way, receptacle 25 does not interfere with the ability of one or more of shopping basket 1 to be stacked for storage.

As discussed above regarding the structure of walls 3 6, wall 27 of receptacle 25 can be formed without openings therethrough in order to prevent any articles that are placed therein from falling through wall 27 of receptacle. Wall 25 can also be formed of a ribbed or a lattice structure, as long as the gaps or openings in wall 27 are sufficiently small or narrow so as to prevent the drink in receptacle 25 from falling through these openings. As shown in the first embodiment of FIG. 1, wall 27 is shown as being formed of vertical ribs 17, in order to match the construction of walls 3–6 of basket 1.

Figure 3:
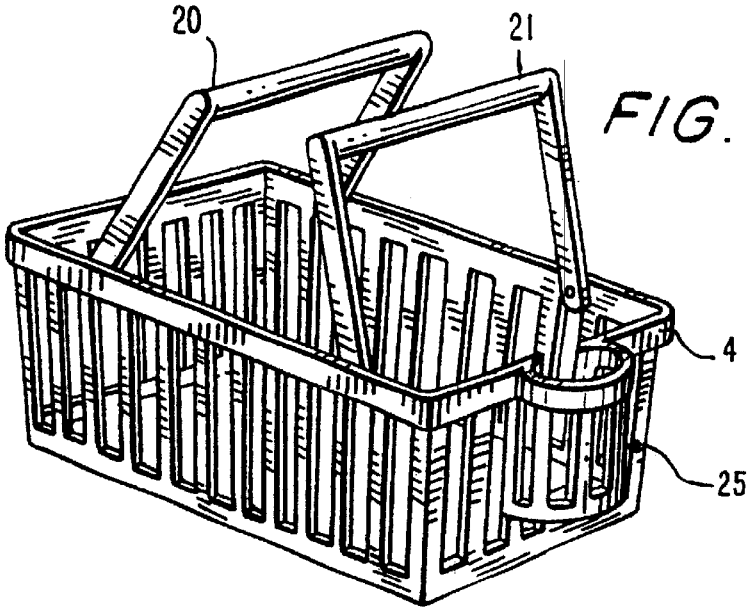
FIG. 3 is a perspective view of a second embodiment of the shopping basket of the current invention.

Although the first, preferred embodiment of this invention is to locate receptacle 25 at the side 6 of basket 1, some shoppers may find it more desirable to locate receptacle 25, not at the side of basket 1, but rather at the end of basket 1. For some shoppers, this orientation may simply be more comfortable during shopping. In an alternative embodiment of this invention, as shown in FIG. 3, receptacle 25 projects outwardly from end wall 4, instead of from side wall 6, as shown in FIG. 1. This embodiment is similar in all other aspects of construction to the embodiment described above and as shown in FIGS. 1 and 2, except that the user's drink is retained by receptacle 25 at one of ends 3, 4 of basket 1 rather than at one of sides 5, 6.

Figure 4:
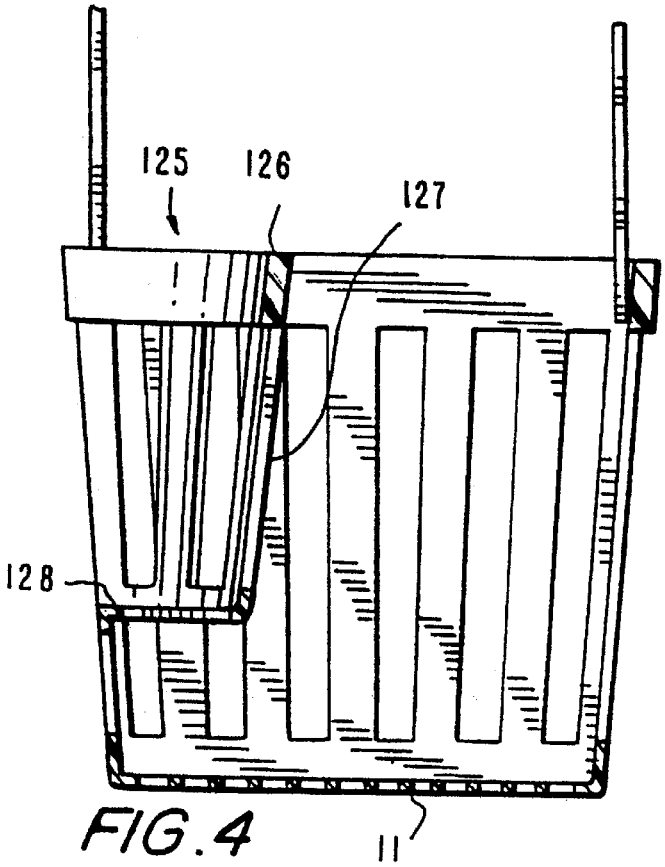
FIG. 4 is a cross-sectional view of the third embodiment of the shopping basket of the current invention.

In a third embodiment of the invention, shown in cross-section in FIG. 4, receptacle 125 could be formed, as in either of the first or second embodiments, at either one of side walls 5, 6 or one of end walls 3, 4 of shopping basket 1. However, in this third embodiment, receptacle 125 protrudes internally into basket 1 rather than outwardly from basket 1. Comparing the cross-sectional view in FIG. 2 of the first embodiment with the cross-sectional view in FIG. 4 of the third embodiment, one can see that wall 127 of receptacle 125 in FIG. 4 is disposed within the air space of basket 1, rather than being disposed outside the airspace of basket 1 as in FIG. 2. Thus, receptacle 125 could still be formed integrally with the corresponding wall 3–6 of shopping basket 1 and with each of the constructions described above, except that the arrangement of cylindrical wall 127 of receptacle 125 and the corresponding wall of shopping basket 1 from which it is formed is reversed from that described above with respect to the first and second embodiments, wherein receptacle 25 protrudes outwardly with respect to basket 1. Accordingly, a user would be able to drink from a can or bottle while shopping and place it into receptacle 125 that is disposed within shopping basket 1. Thus, in this embodiment, there is no protrusion from any of the walls 3–6 of basket 1.

FIG. 6 shows the use of the present invention. In this example, the basket 1 and a container 200 are shown. As described above, the container 200 may be any type of conventional single-serving sized beverage, such as a bottle or a can. In use, a consumer picks up the basket 1 and also picks up the container 200. The consumer opens the container 200 and enjoys a beverage 210 therein, such as a carbonated soft drink, juice, sports drink, or the like. The consumer places the container 200 within the drink holder or the receptacle 25 when the beverage 210 is not being consumed. The receptacle 25 has a sufficient depth to accommodate the single serving sized container 25 without spilling the beverage 210 from the container 200. The consumer than continues to shop by placing other item for purchase in the basket 1. The consumer is free to enjoy the beverage 210 from the container 200 at any time while shopping. The consumer generally pays for the beverage at checkout.

Thus, a shopping basket with an integrally-formed bottle or can holder is provided. One skilled in the art will appreciate that, while preferred embodiments of the present invention have been illustrated and described, the present invention can be practiced by other than the described embodiments, which are provided for purposes of illustration and not limitation, and that that various changes and modifications may be made therein without departing from the scope of the invention as defined in the appended claims.

We claim:

1. A shopping basket for carrying an opened single serving sized beverage can or bottle with a beverage therein, comprising:

a bottom;

a plurality of side panels extending from said bottom; and one of said side panels having a gap therein, said side drink holder attached to the edges of said gap such that the drink holder extends outward of an exterior surface of the side panel, said gap providing an opening between the basket and the drink holder, said gap extending from a bottom of the drink holder to a top edge of the drink holder, said bottom of the drink holder being spaced from and above a top surface of the bottom of the basket;

said drink holder and said one of said plurality of side panels defining a gap within said side panel adjacent to said drink holder and within said drink holder such that said drink holder comprises a continuous extension of said side panel;

said drink holder comprising a depth and a diameter sufficient to accommodate said single serving sized can or bottle such that said shopping basket may be carried with said beverage can or bottle inserted within said drink holder without spilling said beverage.

2. The shopping basket of claim 1, wherein said plurality of side panels each comprise an exterior side and an interior side.

3. The shopping basket of claim 2, wherein said exterior side of one of said side panels comprises said drink holder.

4. The shopping basket of claim 2, wherein said interior side of one of said side panels comprises said drink holder.

5. The shopping basket of claim 1, wherein said plurality of side panels comprises a pair of opposing long sides and a pair of opposing short sides.

6. The shopping basket of claim 5, wherein one of said pair of opposing long sides comprises said drink holder.

7. The shopping basket of claim 5, wherein one of said pair of opposing short sides comprises said drink holder.

8. The shopping basket of claim 1, wherein said plurality of side panels each comprise a center portion and two lateral end portions.

9. The shopping basket of claim 8, wherein said center portion of one of said plurality of side panels comprises said drink holder.

10. The shopping basket of claim 1, wherein said one of said side panels and said drink holder are integrally formed.

11. The shopping basket of claim 1, wherein said one of said side panels and said drink holder are fixedly attached to each other.

12. The shopping basket of claim 1, wherein said drink holder comprises a semi-circular lateral shape.

13. The shopping basket of claim 1, wherein said drink holder comprises a substantially flat base.

14. The shopping basket of claim 1, wherein said bottom, said plurality of side panels, and said drink holder comprise molded plastic.

* * * * *